US009571948B2

(12) United States Patent
Higgins

(10) Patent No.: US 9,571,948 B2
(45) Date of Patent: Feb. 14, 2017

(54) LOW PROFILE OFFSET SPOUT FOR HEARING ASSISTANCE DEVICE

(71) Applicant: Starkey Laboratories, Inc., Eden Prairie, MN (US)

(72) Inventor: Sidney A. Higgins, Maple Grove, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 342 days.

(21) Appl. No.: 14/039,675

(22) Filed: Sep. 27, 2013

(65) Prior Publication Data

US 2014/0161292 A1 Jun. 12, 2014

Related U.S. Application Data

(60) Provisional application No. 61/735,892, filed on Dec. 11, 2012.

(51) Int. Cl.
*H04R 25/00* (2006.01)

(52) U.S. Cl.
CPC ..... *H04R 25/65* (2013.01); *H04R 25/402* (2013.01); *H04R 25/654* (2013.01); *H04R 25/658* (2013.01)

(58) Field of Classification Search
CPC ..... H04R 25/65; H04R 25/658; H04R 25/654; H04R 25/402
USPC ..... 381/322
See application file for complete search history.

(56) References Cited

U.S. PATENT DOCUMENTS 4,366,349 A * 12/1982 Adelman ..... H04R 25/353 381/316
4,736,430 A * 4/1988 Schroder ..... H04R 25/656 381/322
4,870,689 A 9/1989 Weiss
5,425,104 A * 6/1995 Shennib ..... G09B 21/009 381/326

(Continued)

FOREIGN PATENT DOCUMENTS

WO WO-0203752 A2 1/2002

OTHER PUBLICATIONS

"European Application Serial No. 13196652.5, Extended European Search Report mailed Mar. 16, 2015", 6 pgs.

(Continued)

*Primary Examiner* — Davetta W Goins
*Assistant Examiner* — Oyesola C Ojo
(74) *Attorney, Agent, or Firm* — Schwegman Lundberg & Woessner, P.A.

(57) ABSTRACT

Disclosed herein, among other things, are methods and apparatuses for hearing assistance low profile offset spouts. One aspect of the present subject matter relates to a hearing assistance spout consisting of a one-piece spout with a curved path to an off-axis (e.g., offset) port. The spout may be manufactured using metal injection molding to provide for a reflow solder attachment to the hearing assistance microphone. One aspect of the present subject matter relates to placing a full-sized spout off-axis while maintaining an open state that does not restrict the acoustic path, which may allow the offset spout to include a radial seal independent of the microphone body itself. One aspect of the present subject matter relates to an offset spout including a sealed acoustic barrier wall to protect the acoustic inlet of the microphone from debris or moisture.

18 Claims, 3 Drawing Sheets

(56) References Cited

U.S. PATENT DOCUMENTS

| | | | | |
|---|---|---|---|---|
| 6,105,713 | A | 8/2000 | Brimhall et al. | |
| 8,284,973 | B2 | 10/2012 | Gabathuler et al. | |
| 8,761,423 | B2 * | 6/2014 | Wagner | H04R 25/602 381/322 |
| 2002/0006211 | A1 * | 1/2002 | Geskus | H04R 1/342 381/356 |
| 2005/0232453 | A1 * | 10/2005 | Fideler | H04R 25/604 381/322 |
| 2007/0286442 | A1 * | 12/2007 | Hessel | H04R 25/60 381/322 |
| 2008/0269829 | A1 * | 10/2008 | Li | A61L 27/06 607/36 |
| 2011/0182452 | A1 * | 7/2011 | Lin | H04R 25/658 381/325 |
| 2011/0299712 | A1 | 12/2011 | Bondo et al. | |
| 2011/0299713 | A1 | 12/2011 | Moller et al. | |

OTHER PUBLICATIONS

"European Application Serial No. 13196652.5, Office Action mailed Apr. 20, 2015", 2 pgs.

"European Application Serial No. 13196652.5, Response filed Oct. 15, 2015 to Extended European Search Report mailed Mar. 16, 2015", 37 pgs.

* cited by examiner

LOW PROFILE OFFSET SPOUT FOR HEARING ASSISTANCE DEVICE

RELATED APPLICATION

The present application claims the benefit of priority under 35 U.S.C. §119(e) to U.S. Provisional Application Ser. No. 61/735,892, filed on 11 Dec. 2012, which is incorporated herein by reference in its entirety.

FIELD OF THE INVENTION

This document relates generally to hearing assistance systems and more particularly to spout apparatus for microphones for hearing assistance devices.

BACKGROUND

Modern hearing assistance devices, such as hearing aids, typically include digital electronics to enhance the wearer's listening experience. Hearing aids are electronic instruments worn in or around the ear that compensate for hearing losses by specially amplifying sound. Hearing aids use microphones (e.g., transducers) and other electro-mechanical components that are connected via wires to the hearing aid circuitry.

As hearing assistance microphones become smaller (e.g., MEMS microphones), it is becoming increasingly difficult to place a spout on them without sacrificing the size gains. The accepted method and design of hearing assistance microphones arranges a tube in axial alignment with (i.e., orthogonal to) the acoustic port of the microphone. However, this axial alignment configuration creates a direct line-of-sight path for environmental or biological hearing aid debris (e.g., cerumen) to fall into the microphone's internal components. Additionally, the connection between the orthogonal tube and the microphone acoustic port is subject to strain from tube deflection.

Some existing solutions have attempted to solve these issues with a blind tube, notched, welded in place, and epoxied in situ on the exterior of the microphone. However, matching the tube to the profile of the microphone greatly increases the possibility of slit leakage, and the thin wall of the tube limits the structural integrity of the mount and seal. Some existing solutions have attempted to address this issue by eliminating a spout or microphone port. However, using no port requires a face seal on the microphone that may be unreliable, and increases the sensitivity of the face seal to the variations in manufacturing tolerance found in microphone manufacture.

Some existing solutions require a barrier placed in the acoustic path after the spout. However, such a barrier requires the creation of a seal, and due the thin-wall nature of the method of manufacture, the seal may be prone to slit leaks or delamination during assembly. Additionally, thin-wall manufacturing requires an exterior wall or combination of walls, but these walls may be very sensitive to variations in manufacturing tolerances.

What is needed in the art is an improved system for reducing the amount of environmental or biological hearing aid debris that falls into the microphones internal components.

SUMMARY

Disclosed herein, among other things, are methods and apparatuses for hearing assistance low profile offset spouts.

One aspect of the present subject matter relates to a hearing assistance spout consisting of a one-piece spout with a curved path to an off-axis (e.g., offset) port. The curved path may include a 90-degree turn at the end, further protecting the acoustic inlet of the microphone from debris or moisture. One aspect of the present subject matter relates to using a thicker wall section and planar mounting surface at the offset spout attachment point. The offset spout configuration may result in a more robust assembly, and may reduce the effect of variations in manufacturing tolerances in the creation of a mounting interface. Other aspects are provided without departing from the scope of the present subject matter.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings that show, by way of illustration, specific aspects and embodiments in which the present subject matter may be practiced. These embodiments are described in sufficient detail to enable those skilled in the art to practice the present subject matter. References to "an," "one," or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter relates, among other things, to methods and apparatuses for hearing assistance low profile offset spouts.

Figure 1A:
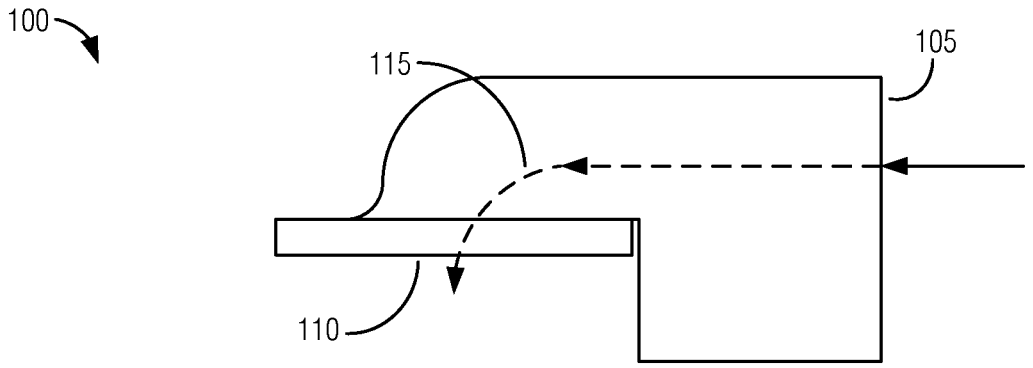
FIGS. 1A, 1B, and 1C are example views of an offset spout according to one embodiment of the present subject matter.
Figure 1B:
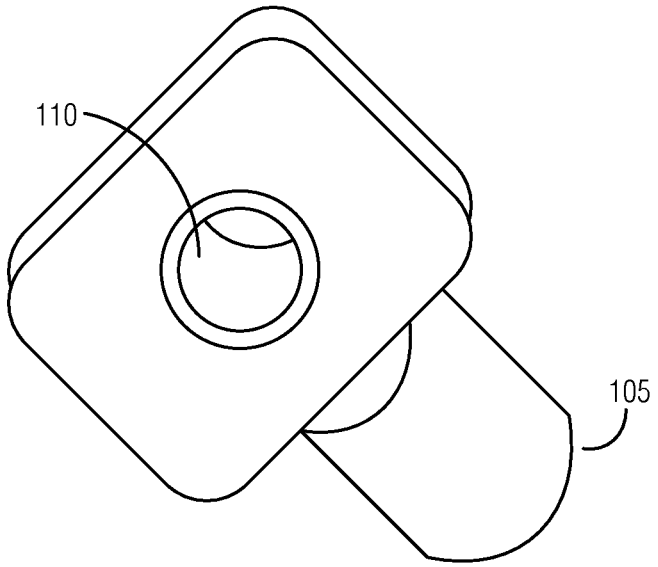
Figure 1C:
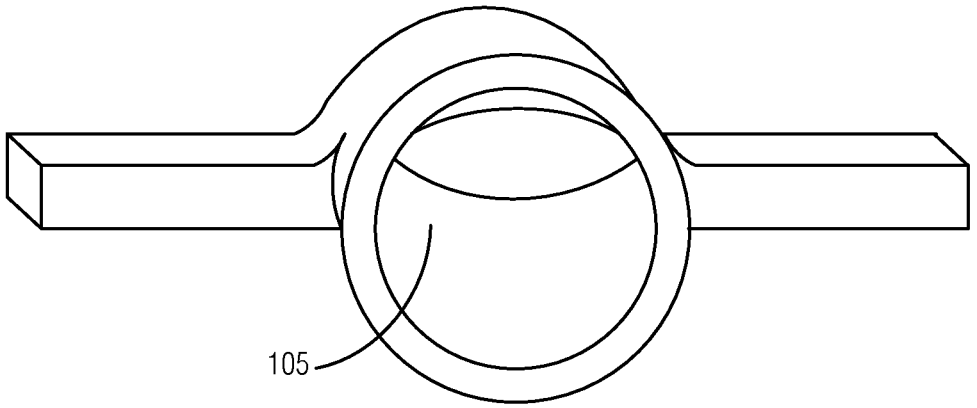

FIGS. 1A, 1B, and 1C are example views of an offset, low-profile spout 100 according to one embodiment of the present subject matter. The low profile spout 100 provides an acoustic inlet port 105 for receiving sound and an acoustic outlet port 110 to a housing or microphone module or capsule. In FIGS. 1A, 1B, and 1C, the cylindrical member has an aperture that defines a curved path 115 and terminates at the acoustic outlet port 110. Although the embodiment shown includes ports and apertures that are circular in nature, it is understood that the present subject matter is not limited to circular holes. Other shapes may be used including, but not limited to, elongate openings, square openings, slit openings, and irregular openings. The apertures may combine different shapes at the acoustic inlet port 105 and at the acoustic outlet 110. Thus, the present subject matter is not limited to the geometries and scale of those in the drawing shown. The offset, low-profile spout acoustic inlet port 105 provides sound to a cavity that is in acoustic communication with the acoustic outlet port 110.

In various embodiments, the offset nature of the spout 100 creates a curved path 115 for debris, which may reduce introduction of environmental or biological debris into a hearing assistance microphone's internal components. The offset spout curved path 115 may include a ninety-degree turn at the end, further protecting the acoustic inlet port 105 of the microphone from debris or moisture. The geometry of the curved path may be configured to increase the acoustic response of the microphone. The offset spout configuration may result in a more efficient use of space in various hearing assistance devices, including behind-the-ear (BTE) and in-the-canal (ITC) hearing assistance devices.

In various embodiments, using the full diameter of the offset spout allows an elastomeric tube to retain and possibly suspend the microphone/spout assembly in a BTE hearing assistance device. Using an elastomeric tube for retention may reduce external forces on the microphone required to create an acoustic seal, thereby reducing the likelihood of damage to the microphone.

In various embodiments, a full-sized spout off-axis may be arranged to maintain an open path that does not restrict the acoustic path, which may allow the offset spout to include a radial seal independent of the microphone body itself. The offset spout may also include a sealed acoustic barrier wall to protect the acoustic inlet of the microphone from debris or moisture.

In various embodiments, the spout 100 may be created via metal injection molding to produce a one piece metal structure that can be soldered directly onto a MIM microphone. The spout 100 may be manufactured using metal injection molding to provide for a reflow solder attachment to the hearing assistance microphone. When reflowed, the spout may be used as the primary attachment point between the microphone and the hearing assistance device substrate, such as is shown in FIGS. 2A, 2B, and 2C.

Figure 2A:
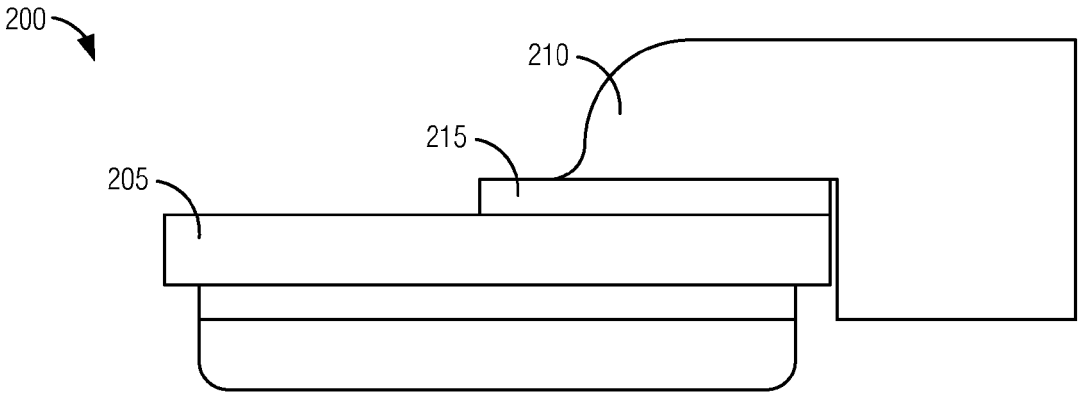
FIGS. 2A, 2B, and 2C are example views of an offset spout mounted on a hearing assistance device substrate according to one embodiment of the present subject matter.
Figure 2B:
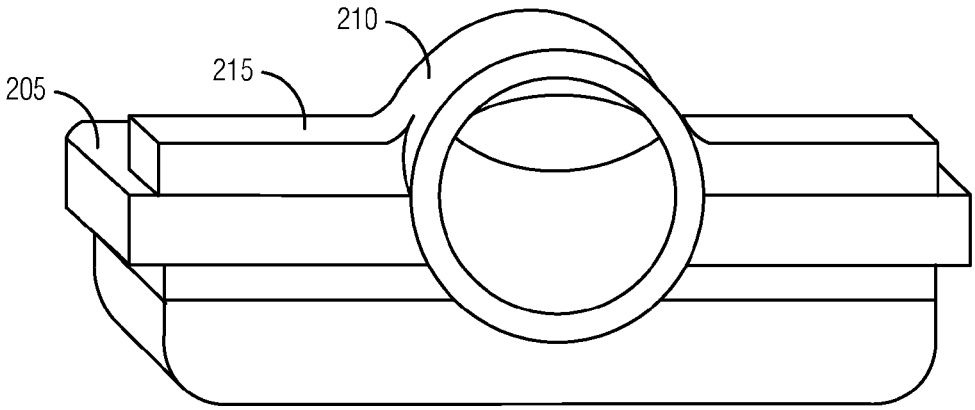
Figure 2C:
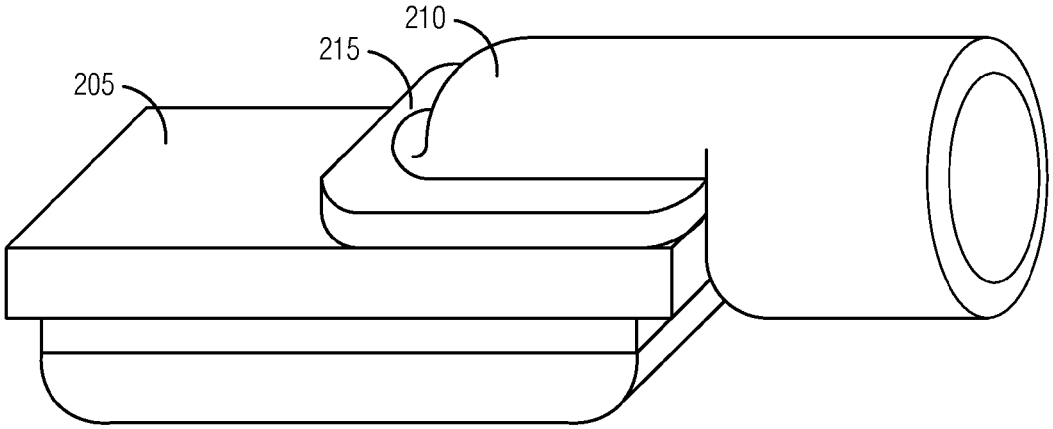

FIGS. 2A, 2B, and 2C are example views of an offset spout 200 mounted on a hearing assistance device substrate 205 according to one embodiment of the present subject matter. In various embodiments, the hearing assistance device substrate 205 may include or may be acoustically coupled to the hearing assistance device microphone. In an embodiment, the offset spout 200 includes a thicker wall section 210 and planar mounting surface 215 at the offset spout attachment point. The planar configuration of the mounting surface may result in a more robust connection between the planar mounting surface 215 and the hearing assistance device substrate 205, and thereby reduce the effect of variations in manufacturing tolerances in the creation of a mounting interface on the hearing assistance device substrate 205. The secure connection provided by the planar mounting surface 215 may also allow the hearing assistance assembly to be suspended by an elastomeric tube.

Figure 3:
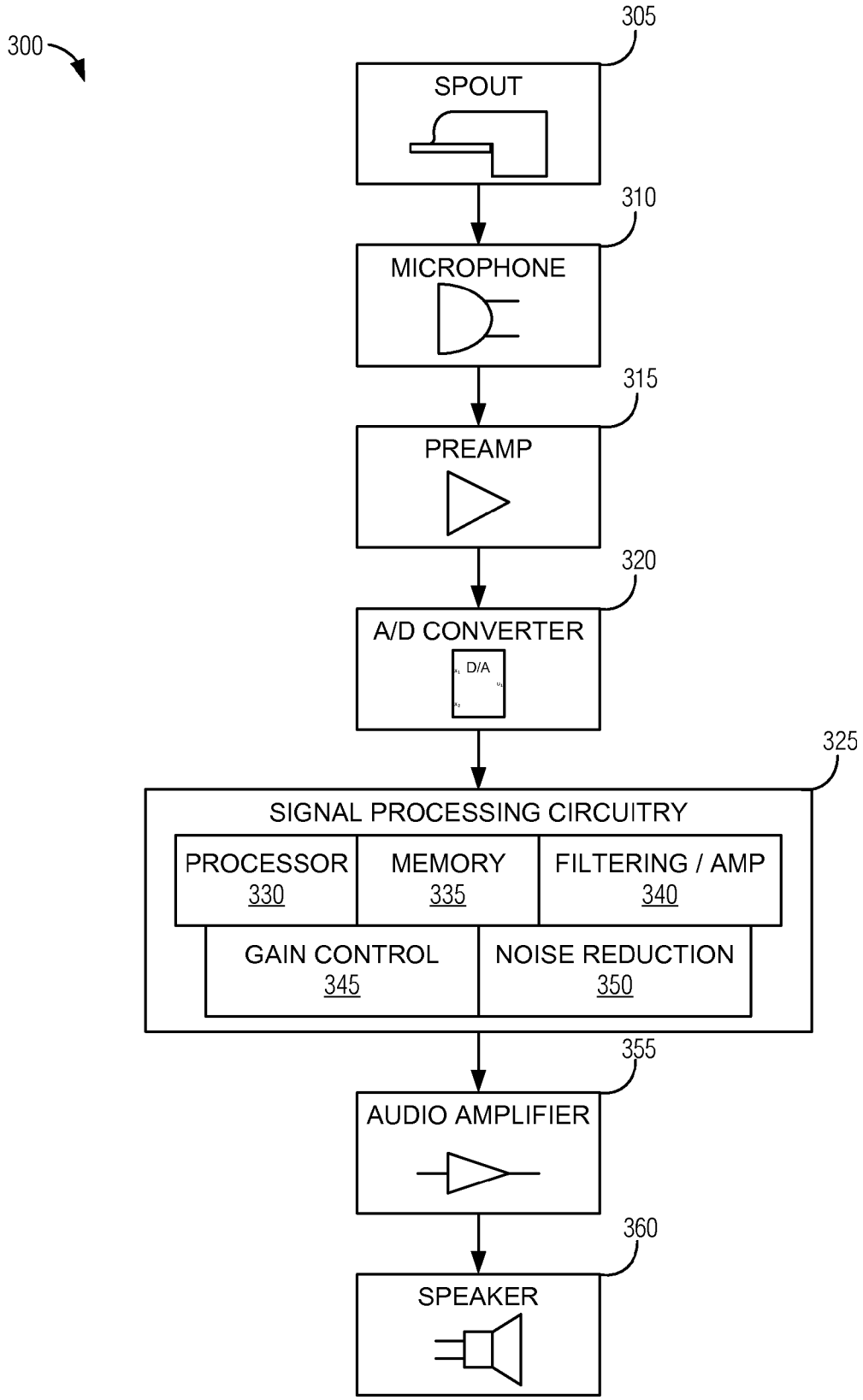
FIG. 3 is a block diagram of the components of an exemplary hearing aid.

FIG. 3 is a block diagram of the components 300 of an exemplary hearing aid. Exemplary hearing aid components 300 include an offset spout 305. The offset spout 305 provides an acoustic inlet port for receiving sound and an acoustic outlet port to provide received sound to a microphone (e.g., input transducer) component 310. The microphone component 310 receives sound from the offset spout 305 and converts the sound into an input signal. After amplification by pre-amplifier 315, the input signal is sampled and digitized by A/D converter 320.

Other embodiments may incorporate an input microphone 310 that produces a digital output directly. The device's signal processing circuitry 325 processes the digitized input signal into an output signal in a manner that compensates for the patient's hearing deficit. The output signal is then passed to an audio amplifier 355 that drives an output speaker (e.g., output transducer) 360 for converting the output signal into an audio output, such as a speaker within an earphone.

In the example illustrated in FIG. 3, the signal processing circuitry 325 includes a programmable controller made up of a processor 330 and associated memory 335 for storing executable code and data. Signal processing circuitry 325 may also include hardware processing modules including a filtering and amplifying module 340, a gain control module 345, and a noise reduction module 350. The signal processing modules 340, 345, and 350 may represent specific code executed by the controller or may represent additional hardware components. The filtering and amplifying module 340 amplifies the input signal in a frequency specific manner as defined by one or more signal processing parameters specified by the controller. As described above, the patient's hearing deficit is compensated by selectively amplifying those frequencies at which the patient has a below normal hearing threshold. Other signal processing functions may also be performed in particular embodiments. The example illustrated in FIG. 3, for example, also includes a gain control module 345 and a noise reduction module 350. The gain control module 345 dynamically adjusts the amplification in accordance with the amplitude of the input signal. Compression, for example, is a form of automatic gain control that decreases the gain of the filtering and amplifying circuit to prevent signal distortion at high input signal levels and improves the clarity of sound perceived by the patient. Other gain control circuits may perform other functions such as controlling gain in a frequency specific manner. The noise reduction module 350 performs functions such as suppression of ambient background noise and feedback cancellation.

The signal processing circuitry 325 may be implemented in a variety of different ways, such as with an integrated digital signal processor or with a mixture of discrete analog and digital components. For example, the signal processing may be performed by a mixture of analog and digital components having inputs that are controllable by the controller that define how the input signal is processed, or the signal processing functions may be implemented solely as code executed by the controller. The terms "controller," "module," "component," or "circuitry" as used herein should therefore be taken to encompass either discrete circuit elements or a processor executing programmed instructions contained in a processor-readable storage medium.

The programmable controller specifies one or more signal processing parameters to the filtering and amplifying module and/or other signal processing modules that determine the manner in which the input signal is converted into the output signal. The one or more signal processing parameters that define a particular mode of operation are referred to herein as a signal processing parameter set. A signal processing parameter set thus defines at least one operative characteristic of the hearing aid's signal processing circuit. A particular signal processing parameter set may, for example, define the frequency response of the filtering and amplifying circuit and define the manner in which amplification is performed by the device. In a hearing aid with more sophisticated signal processing capabilities, such as for noise reduction or processing multi-channel inputs, the parameter set may also define the manner in which those functions are performed.

As noted above, a hearing aid programmed with a parameter set that provides optimal compensation may not be initially well tolerated by the patient. In order to provide for a gradual adjustment period, the controller is programmed to select a parameter set from a group of such sets in a defined sequence such that the hearing aid progressively adjusts from a sub-optimal to an optimal level of compensation delivered to the patient. In order to define the group of parameter sets, the patient is tested to determine an optimal signal processing parameter set that compensates for the patient's hearing deficit. From that information, a sub-optimal parameter set that is initially more comfortable for the patient can also be determined, as can a group of such sets that gradually increase the degree of compensation.

The controller of the hearing aid may then be programmed to select a signal processing parameter set for use by the signal processing circuitry by sequencing through the group of signal processing parameter sets over time so that the patient's hearing is gradually compensated at increasingly optimal levels until the optimal signal processing parameter set is reached. For example, each parameter set may include one or more frequency response parameters that define the amplification gain of the signal processing circuit at a particular frequency. The controller of the hearing aid may be configured to transition between the group of signal processing parameters in response to receiving a specific command from a remote device via a communication interface, or in response to receiving time date from the remote device via the communication interface. For example, the specific command may indicate that the wearer of the hearing aid has entered a noisy environment (e.g., a loud restaurant) and a signal processing parameter with a higher level of noise reduction should be implemented by the controller.

In an example, the overall gain of the hearing aid may be gradually increased with each successively selected signal processing parameter set. If the patient has a high frequency hearing deficit, the group of parameter sets may be defined so that sequencing through them results in a gradual increase in the high frequency gain of the hearing aid. Conversely, if the patient has a low frequency hearing deficit, the hearing aid may be programmed to increase the low frequency gain gradually with each successively selected parameter set. In this manner, the patient is allowed to adapt to the previously unheard sounds through the automatic operation of the hearing aid. Other features implemented by the hearing aid in delivering optimal compensation may also be automatically adjusted toward the optimal level with successively selected parameter sets such as compression parameters that define the amplification gain of the signal processing circuit at a particular input signal level, parameters defining frequency specific compression, noise reduction parameters, and parameters related to multi-channel processing.

A hearing assistance device may include a microphone, an acoustic microphone port, and a low-profile hearing assistance spout device. The spout device may include a planar portion and a spout portion. The planar portion may include a planar surface, and the planar surface may be configured to be attached to the acoustic microphone port of a hearing assistance device. The spout device may also include a radial seal disposed between the planar surface and the acoustic microphone port. The planar portion may have a longer dimension in the planar plane than a planar height dimension perpendicular to the planar plane. The planar portion may include an opening for the passage of sound. The spout portion may be connected to the planar portion. The spout portion may include an aperture for sound, and the spout portion may be connected to opening of the planar portion to provide an acoustic pathway for sound from the microphone. The geometry of the acoustic pathway for sound may be configured to increase the acoustic response of a hearing assistance device acoustic microphone port. The spout portion may be connected such that it includes a curve to orient the spout portion at an angle that is not perpendicular to the planar surface, where the spout orientation may provide reduced ingress of unwanted materials reaching the microphone. The spout portion angle may be approximately ninety degrees.

Within the low-profile hearing assistance spout device, the planar portion and spout portion may be manufactured using a single piece of material. The planar portion and spout portion may be manufactured using metal injection molding to allow reflow solder attachment of the planar portion to a hearing assistance device acoustic microphone port.

The low-profile hearing assistance spout device may also include a straight portion, where the straight portion may be connected to the spout portion on the spout portion end opposite from the planar portion. The straight portion may have a longer dimension in the planar plane than in a straight portion height dimension perpendicular to the planar plane. The straight portion may also provide reduced ingress of unwanted materials reaching the microphone.

Within the low-profile hearing assistance spout device, the planar portion, spout portion, and straight portion may be manufactured using a single piece of material. The planar portion, spout portion, and straight portion may be manufactured using metal injection molding to allow reflow solder attachment of the planar portion to a hearing assistance device acoustic microphone port.

The low-profile hearing assistance spout device may also include an elastomeric tube connected to the straight portion on the straight portion end opposite from the spout portion. The elastomeric tube may also provide reduced ingress of unwanted materials reaching the microphone. The spout device may be suspended by the elastomeric tube.

A hearing assistance device may include a signal processing circuitry component, a microphone, and a low-profile hearing assistance spout device. The signal processing circuitry component may process acoustic signals received from the microphone and spout device. The microphone may be connected to the signal processing circuitry component to provide input acoustic signals to the signal processing circuitry component. The microphone may include an acoustic microphone port.

The hearing assistance device may include an audio amplifier and a speaker. The audio amplifier may be connected to the signal processing circuitry component, and may receive and amplify processed acoustic signals. The speaker may be connected to the audio amplifier, and may convert amplified processed acoustic signals into sound.

The hearing assistance device may include a preamp and an analog-to-digital converter. The preamp may be connected to the microphone, and may amplify the input acoustic signals. The analog-to-digital converter may be connected between the preamp and the signal processing circuitry component, and may convert the amplified input acoustic signals to digital signals.

The hearing assistance signal processing circuitry component may include a processor module, a memory module, a filtering and amplifying module, a gain control module, and a noise reduction module. The processor module may execute a plurality of executable code and data. The memory module may store the plurality of executable code and data that is processed by the processor module. The filtering and amplifying module may amplify the input acoustic signals in a frequency specific manner. The gain control module may adjust an input acoustic signal amplitude dynamically. The noise reduction module may provide feedback cancellation or to suppress a plurality of ambient background noise.

The hearing assistance device low-profile hearing assistance spout device may include a planar portion and a spout portion. The planar portion may include a planar surface, and the planar surface may be configured to be attached to the acoustic microphone port of a hearing assistance device. The spout device may also include a radial seal disposed between the planar surface and the acoustic microphone port. The planar portion may have a longer dimension in the planar plane than a planar height dimension perpendicular to the planar plane. The planar portion may include an opening for the passage of sound. The spout portion may be connected to the planar portion. The spout portion may include an aperture for sound, and the spout portion may be connected to opening of the planar portion to provide an acoustic pathway for sound from the microphone. The geometry of the acoustic pathway for sound may be configured to increase the acoustic response of a hearing assistance device acoustic microphone port. The spout portion may be connected such that it includes a curve to orient the spout portion at an angle that is not perpendicular to the planar surface, where the spout orientation may provide reduced ingress of unwanted materials reaching the microphone. The spout portion angle may be approximately ninety degrees. The spout device planar portion and spout portion may be manufactured using a single piece of material. The planar portion and spout portion may be manufactured using metal injection molding to allow reflow solder attachment of the planar portion to a hearing assistance device acoustic microphone port.

The hearing assistance device low-profile hearing assistance spout device may include a straight portion, where the straight portion may be connected to the spout portion on the spout portion end opposite from the planar portion. The straight portion may have a longer dimension in the planar plane than in a straight portion height dimension perpendicular to the planar plane. The straight portion may provide reduced ingress of unwanted materials reaching the microphone. The planar portion, spout portion, and straight portion may be manufactured using a single piece of material. The planar portion, spout portion, and straight portion may be manufactured using metal injection molding to allow reflow solder attachment of the planar portion to a hearing assistance device acoustic microphone port. The spout device may also include an elastomeric tube, where the elastomeric tube may be connected to the straight portion on the straight portion end opposite from the spout portion. The elastomeric tube may provide reduced ingress of unwanted materials reaching the microphone.

It is understood that variations in communications circuits, protocols, antenna configurations, and combinations of components may be employed without departing from the scope of the present subject matter. Hearing assistance devices typically include an enclosure or housing, a microphone, and hearing assistance device electronics. Hearing assistance device electronics typically include processing electronics, and a speaker or receiver. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that a variety of hearing assistance devices may be used without departing from the scope and the devices described herein are intended to demonstrate the subject matter, but not in a limited, exhaustive, or exclusive sense. It is also understood that the present subject matter can be used with devices designed for use in the right ear or the left ear or both ears of the wearer.

It is understood that hearing aids typically include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples may omit certain modules that perform frequency synthesis, frequency analysis, analog-to-digital conversion, digital-to-analog conversion, amplification, and certain types of filtering and processing. In various embodiments, the processor is adapted to perform instructions stored in memory that may or may not be explicitly shown. Various types of memory may be used, including volatile and nonvolatile forms of memory. In various embodiments, instructions are performed by the processor to perform a number of signal processing tasks. In such embodiments, analog components may be in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), receiver-in-canal (RIC), and completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used with in-the-ear (ITE) and in-the-canal (ITC) devices. The present subject matter may also be used in non-prescriptive amplification devices. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A low-profile hearing assistance spout device for a hearing assistance device including a microphone having a planar acoustic microphone port, the spout device comprising:

a planar portion, the planar portion configured to mount adjacent the microphone with a planar surface forming an opening in alignment with the planar acoustic microphone port of the hearing assistance device; and a cylindrical spout portion connected to the planar portion, the cylindrical spout portion including an aperture that defines a curved path for sound, the aperture offset from the planar portion surface so that the planar portion surface is approximately coplanar with the center of the aperture, the cylindrical spout curved path in acoustic communication with the planar acoustic microphone port to provide an acoustic pathway for sound received by the cylindrical spout portion to reach the microphone, the cylindrical spout curved path forming a spout connection to the planar portion at an angle that is not perpendicular, the aperture offset and spout connection to reduce ingress of unwanted materials that may reach the microphone.

2. The low-profile hearing assistance spout device of claim 1, wherein the planar portion and cylindrical spout portion are manufactured using a single piece of material.

3. The low-profile hearing assistance spout device of claim 2, wherein the planar portion and cylindrical spout portion are manufactured using metal injection molding to allow reflow solder attachment of the planar portion to the hearing assistance device planar acoustic microphone port.

4. The low-profile hearing assistance spout device of claim further including a straight portion connected to the cylindrical spout curved path on its end opposite from the planar portion.

5. The low-profile hearing assistance spout device of claim 4, wherein the planar portion, cylindrical spout portion, and straight portion are manufactured using a single piece of material.

6. The low-profile hearing assistance spout device of claim 4, further including an elastomeric tube connected to the straight portion on an end opposite from the cylindrical spout portion, the elastomeric tube to further reduce ingress of unwanted materials that may reach the microphone.

7. The low-profile hearing assistance spout device of claim 6, wherein the spout device is suspended by the elastomeric tube.

8. The low-profile hearing assistance spout device of claim 1, wherein the cylindrical spout curved path is connected to the planar portion about a curve of approximately ninety degrees.

9. The low-profile hearing assistance spout device of claim 1, further including a radial seal disposed between the planar surface and the hearing assistance device planar acoustic microphone port.

10. The low-profile hearing assistance spout device of claim 1, wherein the geometry of the acoustic pathway for sound is configured to increase the acoustic response of the hearing assistance device planar acoustic microphone port.

11. The low-profile hearing assistance spout device of claim 1, further comprising:

a signal processing circuitry component to process received acoustic signals, wherein the microphone is connected to the signal processing circuitry component to provide input acoustic signals to the signal processing circuitry component; and an audio amplifier connected to the signal processing circuitry component to receive and amplify processed acoustic signals;

wherein the microphone is disposed adjacent to the planar acoustic microphone port to provide the acoustic pathway for sound received by the cylindrical spout portion to reach the microphone.

12. The low-profile hearing assistance spout device of claim 11, further including:

a preamp connected to the microphone to amplify the input acoustic signals;

an analog-to-digital converter connected between the preamp and the signal processing circuitry component to convert the amplified input acoustic signals to digital signals; and a speaker connected to the audio amplifier to convert amplified processed acoustic signals into sound.

13. The low-profile hearing assistance spout device of claim 11, wherein the signal processing circuitry component further includes:

a filtering and amplifying module to amplify the input acoustic signals in a frequency specific manner;

a gain control module to adjust dynamically an input acoustic signal amplitude; and a noise reduction module to provide feedback cancellation or to suppress a plurality of ambient background noise.

14. The low-profile hearing assistance spout device of claim 11, further including a radial seal disposed between the planar surface and the planar acoustic microphone port.

15. The low-profile hearing assistance spout device of claim 11, wherein the geometry of the acoustic pathway for sound is configured to increase the acoustic response of a hearing assistance device planar acoustic microphone port.

16. The low-profile hearing assistance spout device of claim 11, wherein the spout device is manufactured using metal injection molding to allow reflow solder attachment of the spout device planar portion to the planar acoustic microphone port.

17. The low-profile hearing assistance spout device of claim 11, wherein the spout device further includes a straight portion connected to the cylindrical spout curved path on an end opposite from the planar portion.

18. The low-profile hearing assistance spout device of claim 17, wherein the spout device further includes an elastomeric tube connected to the straight portion on an end opposite from the cylindrical spout portion.

* * * * *